US005740641A

United States Patent [19]

Oxnard

[11] Patent Number: 5,740,641

[45] Date of Patent: Apr. 21, 1998

[54] SELF STORAGE FACILITY HAVING INSULATED STORAGE ROOMS

[75] Inventor: Henry J. Oxnard, Spring, Tex.

[73] Assignee: Adeline Investment Properties, L.L.P., Houston, Tex.

[21] Appl. No.: 831,732

[22] Filed: Apr. 1, 1997

[51] Int. Cl.[6] ..... E04B 1/348; E06B 7/08

[52] U.S. Cl. ..... 52/234; 160/209; 160/201; 454/305; 52/64; 52/79.1; 52/174

[58] Field of Search ..... 52/234, 243.1, 52/243, 79.1, 64, 174; 160/201, 209, 113; 454/305

[56] References Cited

U.S. PATENT DOCUMENTS

| | | | |
|---|---|---|---|
| 2,619,684 | 12/1952 | Elliott | 52/175 |
| 3,457,983 | 7/1969 | Pemberton et al. | 160/209 X |
| 3,803,778 | 4/1974 | Short | 52/174 X |
| 3,980,123 | 9/1976 | Vago | 160/201 |
| 3,996,704 | 12/1976 | Huey | 52/234 X |
| 4,041,661 | 8/1977 | Hurwitz | 52/174 X |
| 4,250,941 | 2/1981 | McNally | 160/209 |
| 4,269,253 | 5/1981 | Ziegler | 160/201 |
| 4,284,173 | 8/1981 | Patterson | 52/174 X |
| 4,449,562 | 5/1984 | Leivenson et al. | 160/113 |
| 4,525,953 | 7/1985 | Stutzman | 160/209 X |
| 4,643,239 | 2/1987 | Wentzel | 160/209 X |
| 4,876,832 | 10/1989 | Wasserman | 52/79.1 |
| 5,016,391 | 5/1991 | Miller et al. | 52/64 X |
| 5,370,578 | 12/1994 | Yi | 454/305 |
| 5,507,121 | 4/1996 | Taylor | 52/174 X |

*Primary Examiner*—Wynn Wood Coggins

*Attorney, Agent, or Firm*—Bush, Riddle, & Jackson, L.L.P.

[57] ABSTRACT

A self storage warehouse facility (10) has a plurality of separate insulated self storage rooms (12) each having an exterior foldable door (14) mounted for movement between open and closed positions to permit access to the insulated storage room (12). The foldable door (14) has a plurality of insulated partitions (50, 52, 54) having rollers (66) mounted in guide rails or tracks (42) for movement. In closed position, the lower partition (54) has a lower tubular seal (74) which seals against the foundation (11) and an adjacent ledge (74, FIG. 4). The entire outer perimeter of the door (14) is sealed against a rubber strip (40) along the side edges and upper edge of the door (14). A tubular seal (72) seals along the bottom edge of the door (14). A solenoid operated damper (82, FIG. 7) in a cool air duct (80) is moved to a closed position by energizing of the solenoid (87) upon opening of the door (14). The damper (82) is opened upon return of the door (14) to a closed position.

10 Claims, 2 Drawing Sheets

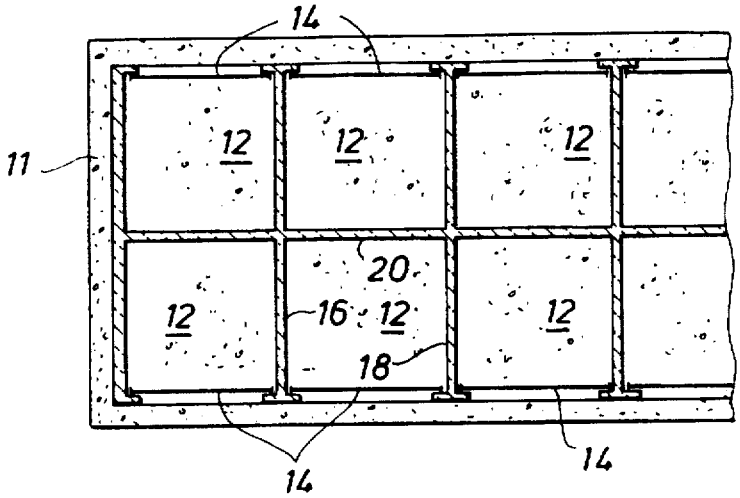
FIG. 1
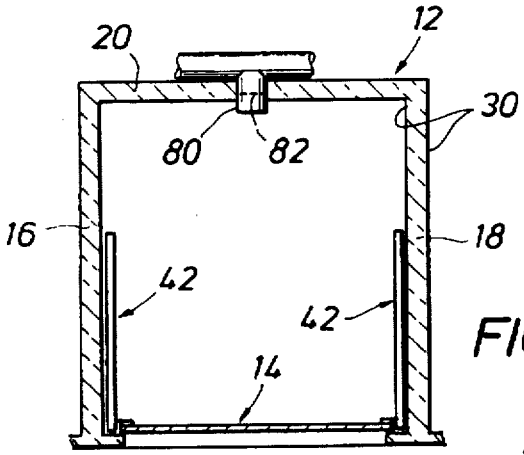
FIG. 2
FIG. 4
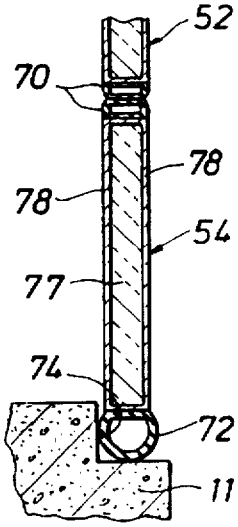
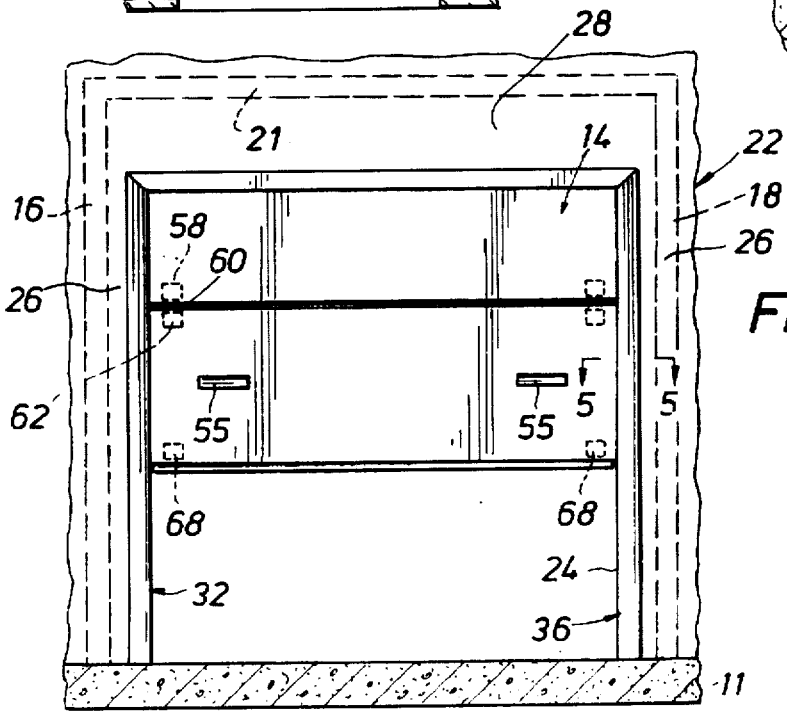
FIG. 3
FIG. 5
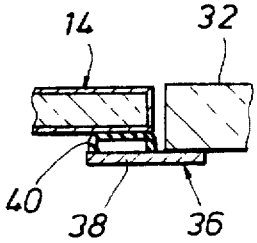

SELF STORAGE FACILITY HAVING INSULATED STORAGE ROOMS

FIELD OF THE INVENTION

This invention relates to a self storage facility, and more particularly to a self storage warehouse facility having a plurality of insulated storage rooms or units which are normally rented or leased to others.

BACKGROUND OF THE INVENTION

Heretofore, self storage warehouses or facilities have been provided which include a plurality of separate insulated rooms or units, each available for rental or lease. However, it has been common heretofore to provide such storage rooms with interior entrance doors so that a person first has to enter a common outside door from the outside in order to gain entrance to a separate interior door for the insulated storage room. Thus, any loss of air conditioning occurs primarily by opening the common exterior entrance door since the interior of the warehouse is air conditioned. Such an arrangement has been thought to be necessary in order to conserve air conditioning or cool air required to maintain a temperature of about 70 F. to 75 F. particularly in hot geographic areas or zones.

The common exterior door has generally been of a relatively small width, such as three (3) feet. Thus, access to insulated storage rooms has not been convenient and oftentimes it has been difficult to store large items.

It is an object of the present invention to provide a self storage warehouse facility having a plurality of insulated storage rooms with each room being accessible from a single outside door.

A further object of the invention is to provide such a self storage insulated storage room in which the outside door comprises an insulated foldable garage door to permit access to substantially the entire width of the insulated storage rooms by a vehicle.

SUMMARY OF THE INVENTION

The present invention is directed particularly to a self storage facility or warehouse having a plurality of insulated self storage rooms each accessible by an exterior insulated door. The outside door preferably comprise a foldable garage door mounted on guide rails for movement between open and closed positions. The width of the storage room may vary but generally the width is only one (1) or two (2) feet greater than the width of the outside door. By providing a garage type door of standard dimensions, a vehicle may easily gain access or entry to the insulated storage room for unloading items into the storage rooms and for transporting items from the storage rooms. The door frame is provided with weather stripping about the sides for sealing against the door and the bottom of the door carries a tubular seal for sealing against the floor in closed position thereby to seal the door about its entire periphery.

The side walls and top or ceiling wall are insulated to minimize loss of cooling air when the door is open. Also, a damper closes the cool air duct upon opening of the door so that the flow of cooling air to the enclosed space of the room is stopped while the door is open. While the air space within the insulated room is exposed to atmosphere upon opening of the door and the cool air inside the room flows out in the event of high outside temperatures, such as 90 F., the loss of cool air is restricted to the insulated room. After the door is closed, the cool air duct is opened and the enclosed space is quickly filled with cool air to the desired temperature. The folding door has insulated door panels of a sandwich construction including an inner polyurethane foam material of around two (2) inches in thickness between a pair of thin outer metal sheets. Tubular insulation strips are provided between adjacent folding panels and seal against each other in the closed position of the door.

A solenoid operated damper for the cool air duct to the room automatically closes the duct upon raising of the insulated door and automatically opens the duct upon closing of the insulated door thereby to minimize the loss of cool air when the exterior door is open.

Other objects, features, and advantages of the invention will be apparent from the following specifications and drawings.

BRIEF DESCRIPTION OF THE DRAWINGS

FIG. 1 is a top plan view of a self storage warehouse facility having a plurality of insulated self storage rooms each with an exterior garage-type entrance door;

FIG. 2 is an enlarged plan view of a single insulated self storage room illustrating the insulated walls thereof;

FIG. 3 is a front elevational view of the front wall showing the foldable door mounted within a door opening in a partially open position thereof;

FIG. 4 is a sectional view of the lower portion of the foldable door in a closed position sealed against the lower concrete foundation;

FIG. 5 is a sectional view taken generally along the line 5—5 of FIG. 3;

DESCRIPTION OF THE INVENTION

Figure 6:
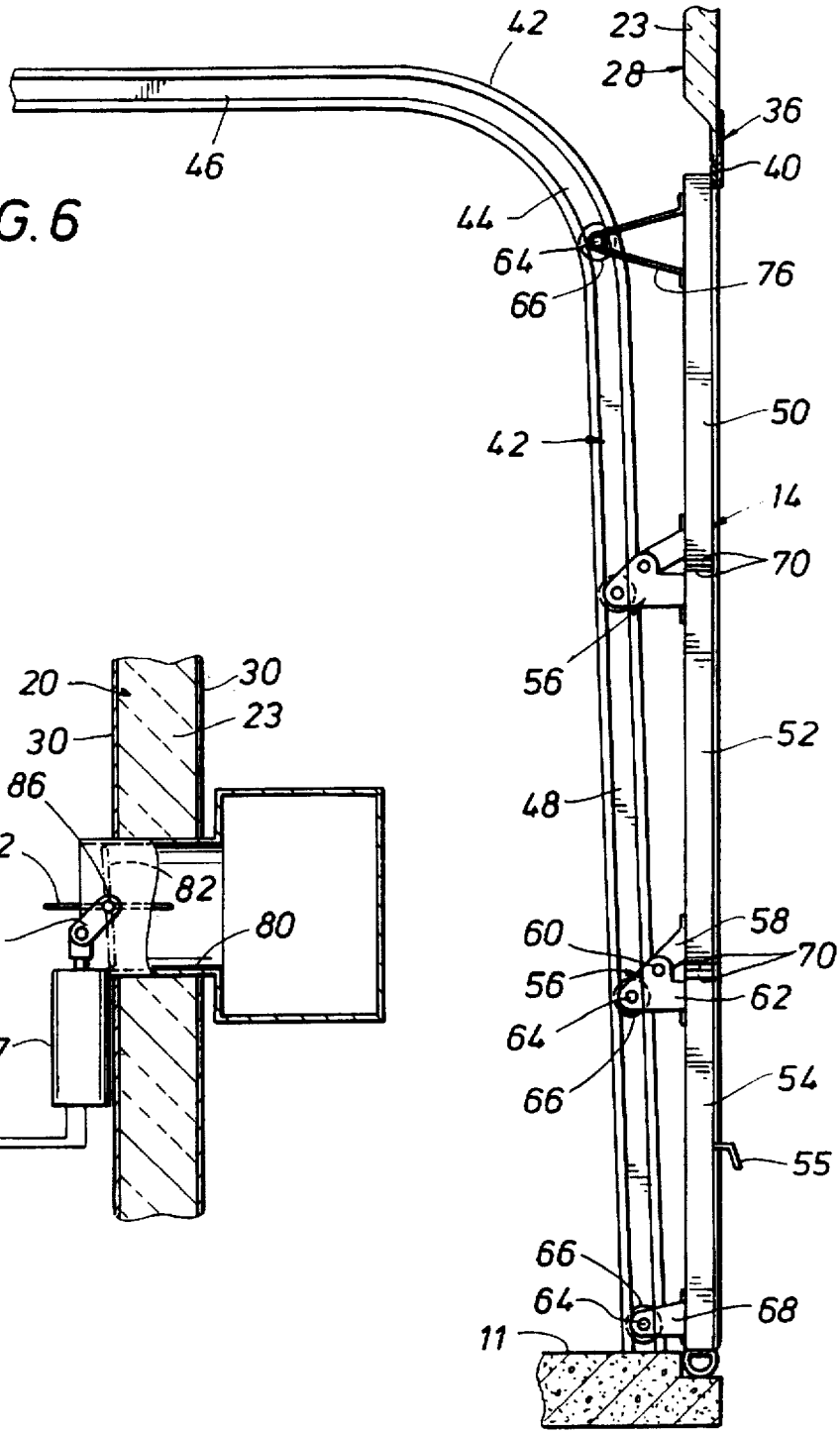
FIG. 6 is a sectional view of the door showing rollers thereon mounted in guide rails supporting the door for movement between open and closed positions and illustrating the movement of the door into a closed position in which the door is sealed about its entire periphery.

Referring now to the drawings for a better understanding of this invention, a self storage facility or warehouse is shown generally at 10 in FIG. 1 having a plurality of separate insulated self storage rooms 12 supported on a concrete foundation or floor 11. Each insulated room 12 has an exterior foldable garage-type door indicated generally at 14 mounted for movement between an open and closed position to permit access to the insulated self storage room 12 for the unloading of items for storage in storage room 12 and to permit loading of items from storage room 12. Each insulated storage room 12 may be separately leased or rented to others.

Insulated storage room 12 has a pair of parallel side walls 16 and 18 connected by an insulated rear wall 20. An insulated top or ceiling wall 21 is mounted over walls 16, 18 and 20. An exterior front wall 22 has a door opening 24 defining a pair of front side wall portions 26 along side door opening 24 and an upper front wall portion 28 above door opening 24. Each wall and wall portion of room 12 is insulated with fiber insulation as shown at 23 in FIG. 7 for rear wall 20. All exterior walls or wall portions are insulated with insulation of about six (6) inches in thickness and a R value of about thirty (30). All interior walls or wall portions are insulated with fiber insulation of about four (4) inches in thickness and a R value of about twenty (20). Thin metal outer covers 30 are mounted on opposed sides of the fibrous insulation for side walls 16, 18, and rear wall 20.

A door frame, generally indicated at 32, is mounted about door opening 24. A sealing strip, generally indicated at 36, is secured along the side and upper edges of door frame 32. Sealing strip 36 includes a support base 38 secured to door frame 32 and an elastomeric seal 40 thereon for engaging the adjacent surface of door 14 in the closed position of door 14. A pair of parallel guide rails or tracks 42 are mounted to side walls 16, 18 and top wall 22. Each track 42 has a curved portion 44 adjacent the upper end of closed door 14 connecting a generally horizontally extending track portion 46 and a vertically extending track portion 48 of track 42.

Foldable door 14 has a plurality of partitions or panels pivotally connected to each other about horizontal axes or joints and including an upper partition 50, intermediate partition 52, and a lower partition 54. Hand holds 55 are provided on lower partition 54 for gripping to raise and lower door 14. Intermediate roller support brackets 56 are mounted on opposed sides of partition 52 adjacent each partition joint including a bracket portion 58 secured to one partition and pivotally connected at 60 to a bracket portion 62 secured to an adjacent partition. A roller shaft 64 having a roller 66 thereon is mounted on bracket portion 62. Roller 66 is mounted in adjacent guide track 42 for rolling movement. Lower partition 54 has a lower roller support bracket 68 on each side thereof for mounting a roller shaft 64 on roller 66 for guiding lower partition 54.

As shown particularly in FIG. 4, each partition has a tubular elastomeric sealing member 70 thereon engaging in sealing relation an adjacent elastomeric sealing member 70 on an adjacent partition. Lower partition 54 has a lower tubular elastomeric sealing member 72 which seals against a ledge 74 on foundation 11 as shown in FIG. 4. Ledge 74 abuts lower partition 54 in the closed position of door 14 to reinforce lower partition 54.

Upper partition 50 has an upper roller support bracket 76 on each upper corner for supporting a roller shaft 64 thereat as shown in FIG. 6. Bracket 76 projects outwardly a substantially greater distance from door 14 than the projecting distance of the remaining brackets. Thus, when lower partition 54 contacts foundation 11 in sealing relation, roller 66 on bracket 76 pushes upper partition 50 into sealing relation with upper sealing strip 40. Thus, insulated door 14 is sealed about its entire periphery when in closed position. Partitions 50, 52, and 54 are each insulated and each partition includes an intermediate foam layer 77 of a polyurethane foam around two (2) inches in thickness. Metal cover sheets 78 are secured to the opposed sides of intermediate foam layer 77 as shown particularly in FIG. 4. The foam layer 77 has a R value of about twenty-five (25).

Figure 7:
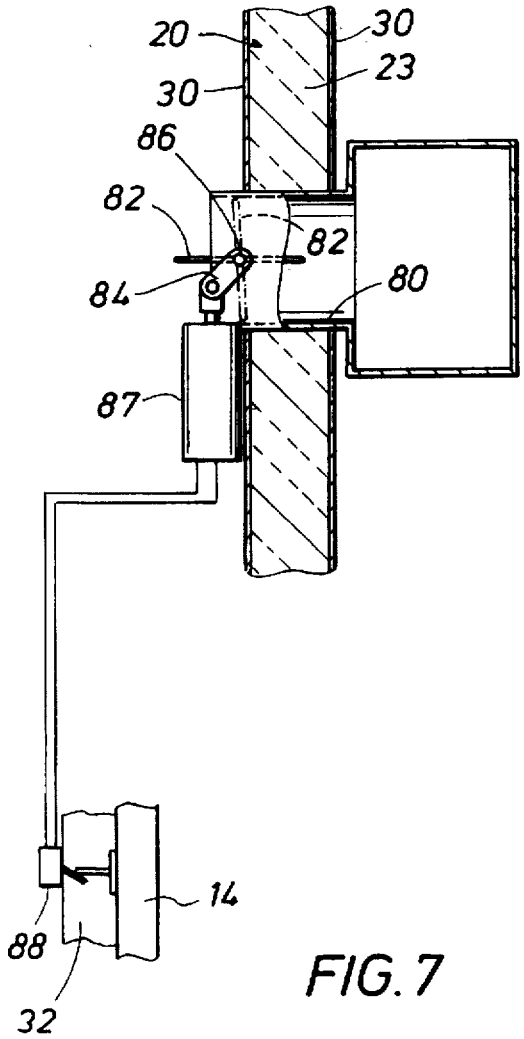
FIG. 7 is a diagrammatic view of a solenoid operated damper mechanism for movement of a damper in the air duct to the self storage room between open and closed positions for selectively supplying air to the insulated storage room.

Referring to FIG. 7, an air conditioning duct 80 is shown extending from rear wall 20. Duct 80 is connected to a suitable air conditioning unit (not shown) for the supply of cool air to insulated storage room 12. A damper 82 is mounted in duct 80 for movement between open and closed positions to control the supply of air to storage room 12. An arm 84 is fixed to shaft 86 for pivoting of damper 82 and a solenoid 87 is connected to arm 84. A solenoid switch 88 is mounted adjacent the lower end of door frame 32. Upon movement of door 14 from a closed position, switch 88 is activated to energize solenoid 87 to move damper 82 to a closed position to stop the flow of cool air to storage room 12. When door 14 returns to closed position, switch 88 is deactivated to deenergize solenoid 87 for opening of damper 82 to permit the supply of cool air to storage room 12 as shown in FIG. 7. Thus, cool air is not supplied to storage room 12 when door 14 is opened. Since all of the walls, wall portions, and door 14 of storage room 12 are insulated, the loss of cooling air is minimized from the remainder of the self storage facility 10 when door 14 is open. Even though door 14 remains open for an extended period of time, the loss of insulation to the remaining self storage rooms is minimized as a result of the highly effective insulation and the closing of the cool air duct.

While the preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A self storage warehouse facility having a plurality of insulated self storage rooms, each of said insulated storage rooms comprising:

a floor;

an exterior front wall;

a pair of side walls and a rear end wall connecting said pair of side walls;

a rectangular exterior door opening in said exterior front wall to provide direct access to the area outside the warehouse;

an insulated foldable door mounted within said door opening for movement between open and closed positions relative to said door opening; said insulated door being of a width to permit access for a vehicle;

said insulated door having a plurality of connected partitions including upper, lower, and intermediate partitions pivotally connected to each other, each partition formed of an inner layer of insulating and having guide rollers extending laterally outwardly;

a pair of parallel tracks mounted along said side walls and receiving said guide rollers for guiding said door between open and closed positions;

a sealing strip mounted along the upper edge and parallel side edges of said door opening; said sealing strip engaging said insulated door in sealing relation in the closed position of said door;

said lower partition having an elastomeric bottom seal thereon for engaging and sealing against said floor in the closed position of said door;

a cool air duct in fluid communication with each of said insulated storage rooms;

a damper positioned in said cool air duct movable between open and closed positions to vary the amount of cool air supplied to an associated storage room; and solenoid operated control means for said damper responsive to opening of said insulated door to close said damper and responsive to closing of said insulated door to open said damper.

2. A self storage warehouse facility as set forth in claim 1 wherein:

said exterior wall is insulated with insulation having a thickness of about six (6) inches and a R value of about 30, said side walls and end wall being insulated with fibrous insulation having a thickness of about four (4) inches and a R value of about 20.

3. A self storage warehouse facility as set forth in claim 2 wherein:

a top wall is secured over said side walls and said end wall; said top wall being insulated with insulation having a thickness about six (6) inches and a R value of about 30.

4. A self storage warehouse facility as set forth in claim 1 wherein:

said upper partition of said foldable door has a rear side with a roller support bracket adjacent each upper corner of said rear side extending outwardly from said rear side in a generally perpendicular direction to define a free projecting end; and an upper guide roller is mounted on the free projecting end of each bracket for engaging an adjacent track, each track having a curved portion thereof adjacent an upper corner of the upper partition in the closed position of said foldable door to guide said roller in a direction for forcing said upper partition into sealing relation against the sealing strip along the upper edge of said door opening when said door is moved to closed position.

5. A self storage warehouse facility as set forth in claim 1;

said partitions being pivotally connected to each other for relative pivotal movement about pivot joints between adjacent partitions;

intermediate roller support brackets are mounted on said partitions adjacent each of said joints and extending outwardly in a generally perpendicular relation from said partitions;

said upper partition having an upper roller support bracket adjacent each upper corner of said upper partition extending outwardly in a generally perpendicular relation from said upper partition a projecting distance substantially greater than the projecting distance of said intermediate roller support brackets; said guide rollers being supported on said roller support brackets and mounted in said parallel tracks for movement between open and closed positions of said foldable door;

each track having a curved portion thereon adjacent an upper corner of said upper partition in the closed position of said foldable door to guide said upper roller in a direction for forcing said upper partition into sealing relation against the sealing strip along the upper edge of said door opening when said door is moved to closed position.

6. A self storage warehouse facility having a plurality of insulated storage rooms, each of said insulated storage rooms comprising:

a horizontal concrete floor;

an exterior front wall;

a pair of interior side walls and an interior rear wall connecting said pair of side walls;

a rectangular exterior door opening in said exterior front wall to provide access to the area outside the warehouse;

an insulated foldable door mounted within said door opening for movement between open and closed positions relative to said door opening; said insulated door being of a width to permit access for a vehicle;

said insulated door having a plurality of insulated connected partitions including upper, lower and intermediate partitions pivotally connected to each other and having guide rollers extending therefrom;

a pair of parallel tracks mounted along said side walls and receiving said guide rollers for guiding said door between open and closed positions;

a sealing strip mounted along the upper edge and parallel side edges of said door opening; said sealing strip engaging said insulated door in sealing relation in the closed position of said door;

said lower partition having an elastomeric bottom seal thereon;

said concrete floor having a vertical ledge adjacent said lower partition in the closed position of said door, said tubular elastomeric bottom seal sealing against said horizontal concrete floor and against said ledge in the closed position of said door with the inner surface of said lower partition in abutting relation with said ledge;

a cool air duct in fluid communication with each of said insulated storage rooms;

a damper positioned in said cool air duct movable between open and closed positions to vary the amount of cool air supplied to an associated storage room; and solenoid operated for said damper control means responsive to opening of said insulated door to close said damper and responsive to closing of said insulated door to open said damper.

7. A self storage warehouse facility as set forth in claim 6 wherein:

said upper partition of said foldable door has a rear side with a roller support bracket adjacent each upper corner of said rear side extending outwardly from said rear side in a generally perpendicular direction to define a free projecting end; and an upper guide roller is mounted on the free projecting end of each bracket for engaging an adjacent track, each track having a curved portion thereof adjacent an upper corner of the upper partition in the closed position of said foldable door to guide said roller in a direction for forcing said upper partition into sealing relation against the sealing strip along the upper edge of said door opening when said door is closed.

8. A self storage warehouse facility as set forth in claim 6;

said partitions being pivotally connected to each other for relative pivotal movement about pivot joints between adjacent partitions;

intermediate roller support brackets are mounted on said partitions adjacent each of said joints and extend outwardly in a generally perpendicular relation from said partitions;

said upper partition having an upper roller support bracket adjacent each upper corner of said upper partition extending outwardly in a generally perpendicular relation from said upper partition a projecting distance substantially greater than the projecting distance of said intermediate roller support brackets; said guide rollers being supported on said roller support brackets and mounted in said parallel tracks for movement between open and closed positions of said foldable door;

each track having a curved portion thereon adjacent an upper corner of said upper partition in the closed position of said foldable door to guide said upper roller in a direction for forcing said upper partition into sealing relation against the sealing strip along the upper edge of said door opening when said door is moved to closed position.

9. A self storage warehouse facility as set forth in claim 1 wherein:

a solenoid is operatively connected to said damper for pivoting of said damper between open and closed positions; and a solenoid switch is engaged by said insulated door in the closed position of said insulated door to deenergize said solenoid to move said damper to an open position, said solenoid switch being disengaged by said insulated door in the open position of said insulated door for energizing of said solenoid to move said damper to a closed position.

10. A self storage warehouse facility as set forth in claim 6 wherein:

a solenoid is operatively connected to said damper for pivoting of said damper between open and closed positions; and a solenoid switch is engaged by said insulated door in the closed position of said insulated door to deenergize said solenoid to move said damper to an open position, said solenoid switch being disengaged by said insulated door in the open position of said insulated door for energizing of said solenoid to move said damper to a closed position.

* * * * *